US007246716B2

(12) United States Patent
Durdon

(10) Patent No.: US 7,246,716 B2
(45) Date of Patent: Jul. 24, 2007

(54) DISPOSABLE CUP LID WITH CONDIMENT TAB

(75) Inventor: Terry Durdon, Guelph (CA)

(73) Assignee: Amhil Enterprises, Mississauga, Ontario (CA)

( * ) Notice: Subject to any disclaimer, the term of this patent is extended or adjusted under 35 U.S.C. 154(b) by 60 days.

(21) Appl. No.: 10/694,852

(22) Filed: Oct. 29, 2003

(65) Prior Publication Data

US 2005/0092749 A1 May 5, 2005

(51) Int. Cl.

| | |
|---|---|
| ***B65D 51/18*** | (2006.01) |
| ***B65D 43/24*** | (2006.01) |
| ***B65D 43/14*** | (2006.01) |
| ***B65D 3/00*** | (2006.01) |
| ***B65D 83/00*** | (2006.01) |
| ***A47G 19/22*** | (2006.01) |

(52) U.S. Cl. ..... 220/254.3; 215/387; 220/837; 220/717; 220/713; 220/254.7; 220/831; 229/404

(58) Field of Classification Search ..... 215/387; 229/404, 906.1; 206/222, 217; 220/836, 220/837, 839, 831, 254.1, 254.3, 254.7, 711–713, 220/716–718

See application file for complete search history.

(56) References Cited

U.S. PATENT DOCUMENTS

| | | | | |
|---|---|---|---|---|
| 4,350,260 | A * | 9/1982 | Prueher | 220/254.3 |
| 4,460,103 | A * | 7/1984 | Rama et al. | 220/254.3 |
| 4,473,167 | A * | 9/1984 | Bailey | 220/712 |
| 4,913,305 | A * | 4/1990 | Hanafusa et al. | 220/269 |
| 5,065,880 | A * | 11/1991 | Horner | 220/711 |
| 5,398,843 | A * | 3/1995 | Warden et al. | 220/711 |
| 5,894,952 | A | 4/1999 | Mendenhall et al. | |
| 5,934,493 | A | 8/1999 | Han | |
| 5,979,647 | A | 11/1999 | Han | |
| 6,089,397 | A * | 7/2000 | Van Melle | 220/270 |
| 6,612,456 | B1 * | 9/2003 | Hundley et al. | 220/254.3 |
| 2003/0102312 | A1 | 6/2003 | Horner | |

FOREIGN PATENT DOCUMENTS

| | | |
|---|---|---|
| EP | 0849187 | 6/1998 |

* cited by examiner

*Primary Examiner*—Robin A. Hylton
(74) *Attorney, Agent, or Firm*—Gowan Intellectual Property; Gerald A. Gowan

(57) ABSTRACT

A disposable cup lid for placement onto the rim of a drinking cup has a cover portion having a drinking access port and a condiment opening, a rim portion, a reclosable and tearable fold-back condiment tab, a hinge, a post and a recess. The cup lid is structured in such a manner that when the condiment opening is not in use, the condiment opening is reclosable by the condiment tab.

17 Claims, 3 Drawing Sheets

DISPOSABLE CUP LID WITH CONDIMENT TAB

FIELD OF THE INVENTION

This invention relates to cup lids, and more particularly relates to a disposable cup lid for covering the open end of a beverage cup, where the addition of condiments to the beverage is desirable by the consumer before the drinking of the beverage. The beverage cup may be used to carry hot beverages such as coffee, tea, hot chocolates, and the like, or it may be used to carry cold beverages such as ice tea, ice coffee, or cappuccino.

BACKGROUND OF THE INVENTION

With the ever increasing demands of our busy lives, more and more people are relying on the convenience of fast food and take-outs. Indeed, the fast food industry has significantly grown over the years, and this in turn has contributed to the growth of the manufacturing of the containers and lids used in holding and containing the food and beverages. One particular area of the fast food industry which has exploded in the recent decades is the sale of coffee, cappuccino, espresso, hot chocolate, tea and the like. These beverages are available both as hot beverages or cold beverages. They are usually sold at cafes, fast food restaurants, and drive-throughs, and are usually available to the consumers as take-away beverages. Beverages of this sort are typically contained in paper or polystyrene cups; and polystyrene plastic disposable cup lids are usually provided for placement over such cups.

Many variations of such disposable cup lids are available in today's market. The disposable cup lids may be relatively flat, or they may be domed or semi-domed. The domed or semi-domed type lids are particularly suitable for beverages such as cappuccinos, hot chocolates, and the like, which typically have some froth or foam at the top of the beverage when it is dispensed into the cup. In the case of cold beverages, the domed or semi-domed type lids provide additional volume for foam or for ice cubes which are floating in the beverage. Whether the lids are flat or domed, the lids are provided with a drinking opening so as to permit the consumer to drink the beverage contained in the cup without having to remove the lid. The opening may be a small drink-through opening that is pre-formed near the peripheral region of the cup lid. In another variation, the drink-through opening is defined by a tearable foldback tab. When the tab is torn and folded back, the drink-through opening is provided in the lid. In yet another variation, the tab may have to be torn off from the lid in order to create the drink-through opening.

A drawback of these conventional disposable cup lids is that the opening provided is not sufficiently large enough for the consumer to add condiments such as sugar, cream, milk and spices into the hot beverage. The opening is designed to serve solely as a drink-through opening, and thus the size of the opening is typically quite small so as to prevent spills or splashes of the hot beverage from the cup. If the consumer wishes to add condiments into the hot beverage, he or she would be required to first remove the lid from the cup, and then add the condiments into the hot beverage. Since most consumers like to enjoy such beverages with at least the addition of some type of condiments, the conventional disposable cup lids do not allow the consumer to add the condiments to the beverage without having to first remove the lid from the cup. Removal of such disposable cup lid from a cup containing a full amount of beverage is difficult, inconvenient, cumbersome, and possibly dangerous in certain circumstances, especially when the consumer is driving, riding in a vehicle, or walking. The difficulty of removing the cup lid is further exacerbated when the beverage contained within the cup is a hot beverage. The consumer purchased the beverage as a take-out item, and as such, the lid and the container provided need to be durable and spill-resistant so as to permit the consumer to be able to carry the beverage around safely.

Attempts have been made to provide disposable cup lids having not only a drink-through opening, but also another port for the consumer to add condiments into the beverage. However, disposable cup lids of this type which are currently available are not very effective, particularly the condiment opening is typically closed off by a resilient means, and thus making the condiment opening not easily accessible when the addition of condiments through the condiment opening into the beverage is desirable.

In United States Patent Application Publication No. 2003/0102312 published to HORNER on Jun. 5, 2003, a disposable lid with a cream and sugar port is taught. The disposable lid is structured in such a manner that when placed on a disposable cup, the user may add condiments to the beverage in the cup without having to remove the lid from the cup. The condiment port is on the opposite side of the lid from the drinking port. Furthermore, the condiment port is defined by a slit which is oriented perpendicularly to an imaginary line that runs through the center of the lid between the drinking port and the condiment port. When the condiment port is in use, the cap can be selectively deformed by the user to create an opening sufficient to allow the introduction of condiments into the cup. When the deforming pressure is removed, the cap is biased to return to its original closed position. In the closed position, the condiment port is substantially blocked by a resilient cap that is unitarily formed as part of the cover. While the cap substantially blocks the condiment port so as to prevent leakage of beverage from the cup, the cap partially obstructs the condiment port even when the condiment port is in use, which makes the addition of condiments through the condiment port difficult and cumbersome.

U.S. Pat. No. 5,894,952 issued to MENDENALL et al. on Apr. 20, 1999 teaches a spill-resistant cup lid with condiment funnel and stirring rod. The lid is adapted for use with a beverage container having a hot beverage held within. The lid has a drink-through opening in the form of an arcuately shaped spout, located adjacent the upper peripheral rim of the cup lid. A condiment funnel opening is located near the center of the lid which serves to channel excess beverage back into the cup, and also through which condiments may be poured into the cup. A stirring rod with a hemispherically shaped flange disposed near the upper portion of the rod is provided. The hemispherical flange rests in the condiment funnel opening and aids the consumer in stirring the beverage. The hemispherical flange helps thermally seal the cup lid to decrease heat loss from the hot beverage. Since the stirring rod with the hemispherical flange is a separate entity from the cup lid, the stirring rod could be misplaced or inadvertently discarded by the user after stirring the condiments into the beverage.

In U.S. Pat. No. 5,934,493 issued to HAN on Aug. 10, 1999, a lid for a beverage container is taught. The lid has a flexible disk-like body and a plurality of slot openings formed in the body. Each of the slot openings is adapted to receive a small container containing additives, such as sugar or cream. Upon application of pressure, the slot opening which is defined by a plurality of intersecting lines breaks open. Near the slot opening, the lid also has protrusions formed therein which create an opening in the container as the container is inserted into the slot opening. When the small additive container is inserted into the slot opening, a release opening is formed in the body of the additive container and the content contained therein is released. The lid as taught by HAN requires the condiments to be packaged in specifically sized additive containers which are compatible with the particular dimensions of such a lid. The consumer using the lid provided by HAN would not be able to use condiments contained in packages or containers currently exist in the market. If the specifically sized additive containers containing the condiments are not available, and the consumer need to use sugar and cream in existing packages or containers, the consumer nevertheless is required to remove the lid from the cup before adding the condiments to the beverage.

U.S. Pat. No. 5,979,647 issued on Nov. 9, 1999 also to HAN is a Continuation-In-Part patent of the above noted United States Patent. In this Continuation-In-Part patent, the inventor teaches a disposable lid for a container in which the lid has pre-stored additives such as sugar or cream contained therein. The lid includes a base member sized to fit over the container where the base member has at least one compartment region with a sealed outlet, and a cover sealing the compartment region to prevent the content from exiting the compartment region. When the cover is actuated, the outlet breaks open and allows the additive in the compartment region to flow into the container. Since each of the compartments has a pre-determined amount of condiments contained therein, once the cover is opened, the entire amount of the condiments contained in the compartment is released into the beverage. Thus, the consumer is not permitted to add a desired amount of condiments into the beverage suitable to the consumer's taste. Further, as soon as one of the condiments contained in such a lid is passed its expiry date, the entire lid has to be discarded which is very uneconomical.

It will be apparent from the foregoing prior art that the disposable cup lids have condiment ports formed therein, and such condiment ports are typically not readily accessible. Further, it will be apparent from the foregoing prior art that the disposable cup lids have condiments pre-contained therein.

SUMMARY OF THE INVENTION

It is an object of the present invention to provide a novel cup lid which obviates or mitigates the disadvantages of the prior art.

In accordance with one aspect of the present invention, a cup lid for placement onto the rim of a drinking cup having a substantially circular opening at its upper end is provided. The cup lid of the present invention comprises a cover portion having at least first and second substantially planar regions, a rim portion around the periphery of the cover portion, a hinge, a reclosable and tearable fold-back condiment tab and a recess in the first substantially planar region. The cover portion has a condiment opening defined in the first substantially planar region, and a drinking access port defined in the second substantially planar region and opposite the condiment opening. The rim portion is sealingly securable to the upper end of the drinking cup. The hinge is formed at least partially along a chord and is bisected by a diameter of the cup lid. The reclosable and tearable fold-back condiment tab is defined by the hinge and by fault lines formed in the first substantially planar region. Further, the reclosable and tearable fold-back condiment tab has an upstanding post provided thereon. The recess is dimensioned to frictionally receive the post of the condiment tab when it is torn and folded back. When the condiment tab is torn and folded back, the condiment opening is accessible.

Preferably, the drinking opening is in the peripheral region of the cover portion. In one embodiment of the present invention, the drinking access port provides a readily accessible drinking opening. In another embodiment of the present invention, the drinking access port is defined by a hanging chad such that when the hanging chad is dislocated from the drinking access port, a drinking opening is provided.

In yet another embodiment of the present invention, the cup lid is dome shaped and is such that the cover portion is disposed above the rim portion. In a further embodiment of the present invention, the first substantially planar region and the hinge are disposed below the second substantially planar region. Preferably, the hinge is an U-shaped hinge.

Typically, but not necessarily, the fault lines defining the reclosable and tearable fold-back condiment tab of the cup lid are pre-cut.

In another embodiment of the present invention, the fault lines defining the reclosable and tearable fold-back condiment tab of the cup lid are scored. In yet another embodiment of the present invention, the fault lines defining the reclosable and tearable fold-back condiment tab of the cup lid are serrated.

In a more preferred embodiment of the present invention, the rim portion has a channel defined therein, and a skirt downwardly extending therefrom such that when the cup lid is sealingly secured to the upper end of the drinking cup, the rim of the drinking cup is received in the channel of the cup lid and frictionally fitted therein.

In keeping with one aspect of the present invention, the cup lid is formed from a sheeted material which has an extrusion grain, and wherein the hinge has an longitudinal axis which is parallel to said extrusion grain. In this embodiment, the cup lid may further comprise at least one stop means which is adjacent to the hinge, on the same side as the recess in the first substantially planar, so as to prevent the tearable fold-back condiment tab from being torn beyond the hinge.

In another aspect of the present invention where the cup lid has a U-shaped hinge, the cup lid is also formed from a sheeted material which has an extrusion grain, and wherein the U-shaped hinge has an longitudinal axis which is substantially perpendicular to the extrusion grain.

Typically, but not necessarily, the upstanding post of the tearable fold-back condiment tab has grip means which aids in the tearing of the condiment tab.

In yet another embodiment of the present invention, the cup lid is flat and is such that the first, and second substantially planar regions of the cover portion lie substantially in the same plane. Still further, the drinking access port is defined by a tearable fold-back drinking tab such that when the drinking tab is torn and folded back, away from the rim portion of the cup lid, the drinking opening is accessible. In still another embodiment, the drinking access port is defined by a tear tab such that when the tab is torn and dislocated away from the drinking access port, a drinking opening is accessible.

BRIEF DESCRIPTION OF THE DRAWINGS

The novel features which are believed to be characteristic of the present invention, as to its structure, organization, and use, together with further objectives and advantages thereof, will be better understood from the following drawings in which presently preferred embodiments of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

The present invention provides a cup lid for covering the open end of a beverage cup, where the addition of condiments to the beverage is desirable by the consumer before the drinking of the beverage. The beverage cup may be used to carry hot beverages such as coffee, tea, hot chocolates, and the like, or it may be used to carry cold beverages such as ice tea, ice coffee, or cappuccino.

Figure 1:
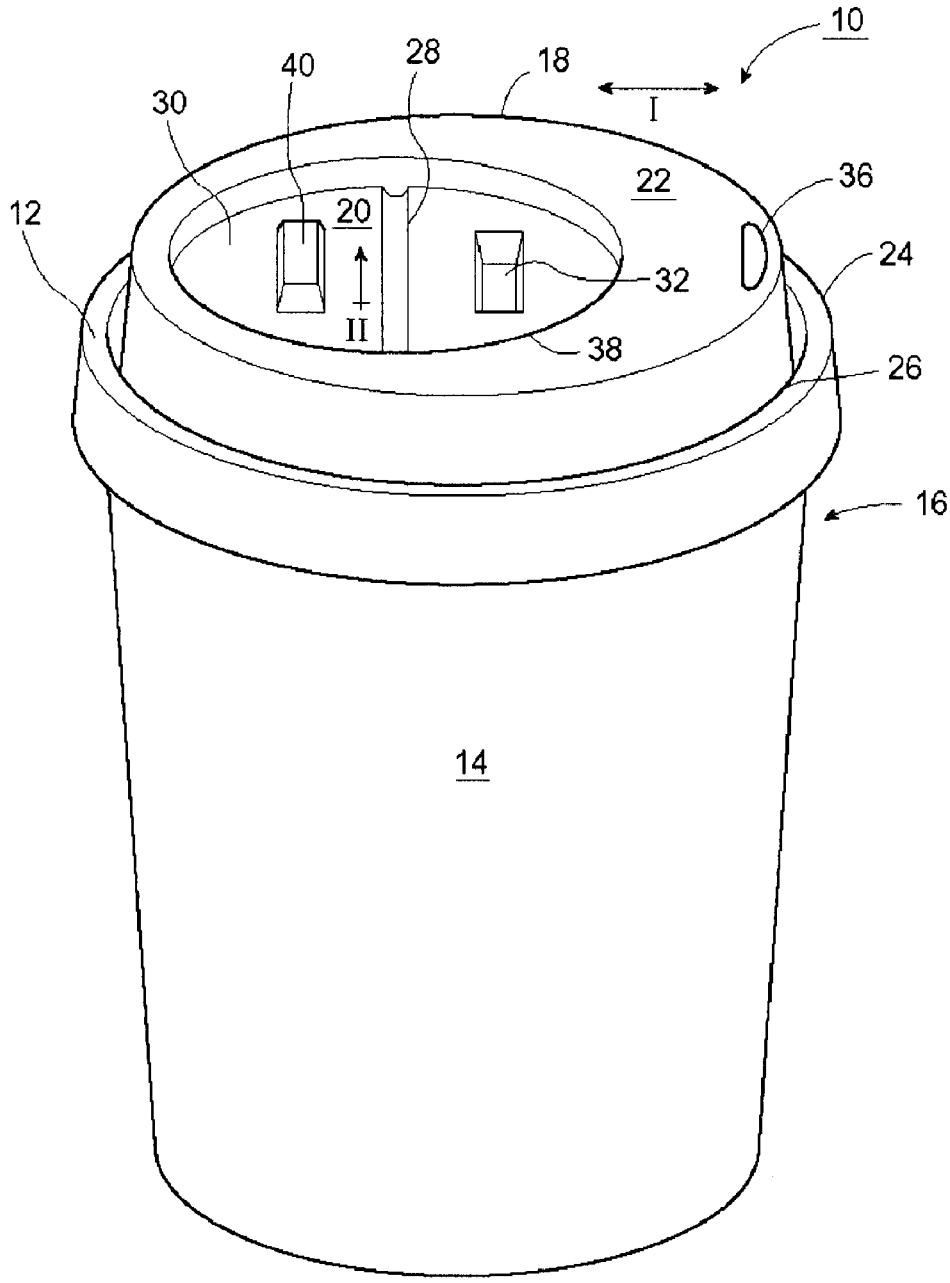
FIG. 1 is a perspective view of a first embodiment of a cup lid in keeping with the present invention, when the cup lid is placed onto the rim of a drinking cup having a substantially circular opening at its upper end, and when the reclosable and tearable fold-back tab is in its closed position.
Figure 2:
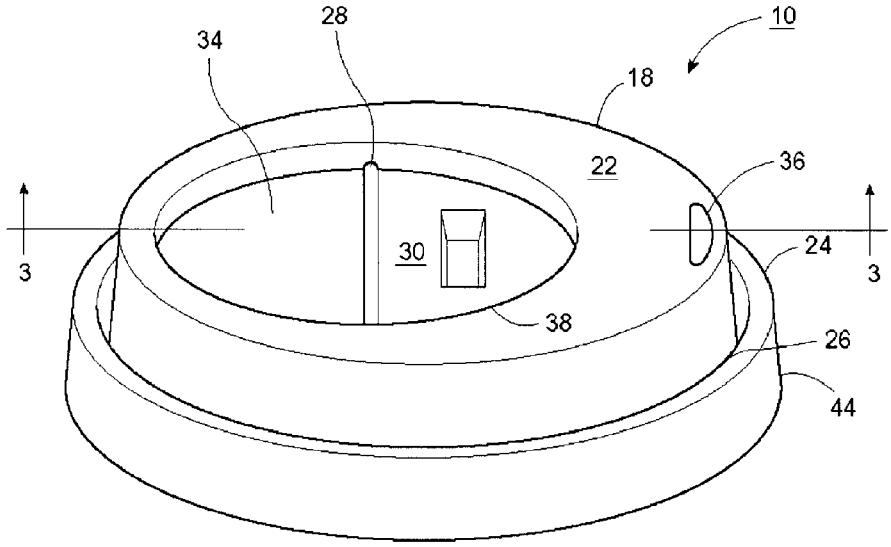
FIG. 2 is a perspective view of a first embodiment of a cup lid in keeping with the present invention, when the reclosable and tearable fold-back tab is in its open position.
Figure 3:
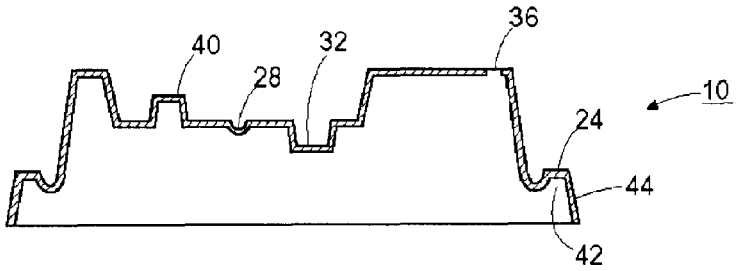
FIG. 3 is a cross-sectional view of a first embodiment of a cup lid in keeping with the present invention along line 3—3 in FIG. 2, when the reclosable and tearable fold-back tab is in its closed position.

Referring first to FIGS. 1 to 3, a first embodiment of a cup lid in keeping with the present invention is shown, in FIG. 1, the cup lid 10 is shown being placed on the rim 12 of a drinking cup 14 which has a substantially circular opening at its upper end 16. The cup lid 10 comprises a cover portion 18 having first and second substantially planar regions 20 and 22 respectively, a rim portion 24 around the periphery 26 of the cover portion 18, a hinge 28, a reclosable and tearable fold-back condiment tab 30, and a recess 32. The condiment opening 34 is defined in the first substantially planar region 20.The said first substantially planar region 20, as shown in the drawings, extends over at least about half of the cover portion 18 Drinking access port 36 is defined in the second substantially planar region 22 and is positioned substantially opposite the condiment opening 34. The rim portion 24 is sealingly securable to the upper end 16 of the drinking cup 14, as can be best seen in FIG. 1. The hinge 28 is formed in the first substantially planar region 20, and furthermore, the hinge is formed at least partially along a chord and is bisected by a diameter of the cup lid. The reclosable and tearable fold-back condiment tab 30 in the first substantially planar region 20 is defined by the hinge 28 and by fault lines 38 formed in the first substantially planar region 20. Moreover, the reclosable and tearable fold-back condiment tab 30 has an upstanding post 40 provided thereon. The recess 32 in the first substantially planar region 20 is dimensioned to frictionally receive the post 40 of the condiment tab 30 when it is torn and folded back, as shown in FIG. 2. When the condiment tab 30 is torn and folded back, the condiment opening 34 is accessible.

In the first embodiment of the present invention, the cup lid 10 is dome shaped. Such dome shaped cup lid 10 is particularly suitable for beverages which have some froth or foam at the top of the beverage when it is dispensed into the cup. In the dome shaped cup lid 10, the cover portion 18 is disposed above the rim portion 24.

The drinking access port 36 of cup lid 10 is in the peripheral region of the cover portion 18. The drinking access port 36 is substantially smaller in size than the condiment opening 34; the drinking access port 36 is unobstructed and is of a size to permit ease of drinking. Typically, the drinking opening 36 of the dome shaped cup lid 10 is preformed. In this particular embodiment, the drinking access port 36 provides a readily accessible drinking opening.

Also, as shown in FIGS. 1 to 3, the hinge 28 is a U-shaped hinge. Typically, the cup lid 10 is formed from a sheeted material which has an extrusion grain indicated by arrow I. Thus, in this specific embodiment, the U-shaped hinge has an longitudinal axis as indicated by arrow II which is substantially perpendicular to the extrusion grain.

In a preferred embodiment of the present invention as shown in FIGS. 1 to 3, the first substantially planar region 20 and the U-shaped hinge 28 are disposed below the second substantially planar region 22 so as to accommodate the lip of the consumer when the consumer is tilting the drinking cup 14 and drinking from the drinking opening 36.

In one embodiment of the cup lid of the present invention, the fault lines 38 are pre-cut. In another embodiment of the present invention, the fault lines 38 are scored. In yet another embodiment of the present invention, the fault lines 38 are serrated.

As best seen in FIGS. 1 an 3, the rim portion 24 typically has a channel 42 defined therein, and a skirt 44 downwardly extending therefrom. As such, when the cup lid 10 is sealingly secured to the upper end 16 of the drinking cup 14, the rim 13 of the drinking cup is received in the channel 42 of the cup lid 10 and frictionally fitted therein.

Figure 6:
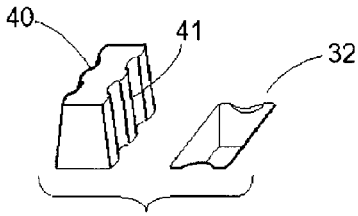
FIG. 6 is an exploded perspective view of the upstanding post, and the complimentary recess which is dimensioned to receive the upstanding post.

As can be seen in FIGS. 1 and 2, upon placement of the cup lid 10 onto the upper end 16 of the drinking cup 14 containing a beverage therein, the consumer may grip the post 40 of the condiment tab 30 and tear the tab 30 away from the rim portion 24 to fold the tab 30 back about the U-shaped hinge 28 to access the condiment opening 34. The post 40 may then be frictionally fitted into recess 32 to lock the post 40 into place and to keep the condiment tab 30 out of the way while the consumer is adding the condiments into the beverage. It is important to note that the post 40 and the recess 32 are positioned substantially equal distant from the U-shaped hinge 28. Turning briefly to FIG. 6, typically, but not necessarily, the upstanding post 40 of the tearable fold-back condiment tab 30 has grip means 41 which aids in the tearing of the condiment tab 30. When the consumer wishes to re-close the condiment opening 34 after the addition of condiments into the beverage, the post 40 is then disengaged from the recess 32 to return the condiment tab 30 to its closed position. Thus, opening and closing of the condiment opening 34 may easily be accomplished by moving the condiment tab 30 away and towards the condiment opening 34. Further, only one hand of the user is required to open and close the condiment opening 34.

As best seen in FIG. 3, the rim portion 20 typically has a channel 40 defined therein, and a skirt 42 downwardly extending therefrom. As such, when the cup lid 10 is sealingly secured to the upper end 16 of the drinking cup 14, the rim 12 of the drinking cup 14 is received in the channel 40 of the cup lid 10 and frictionally fitted therein.

Figure 4:
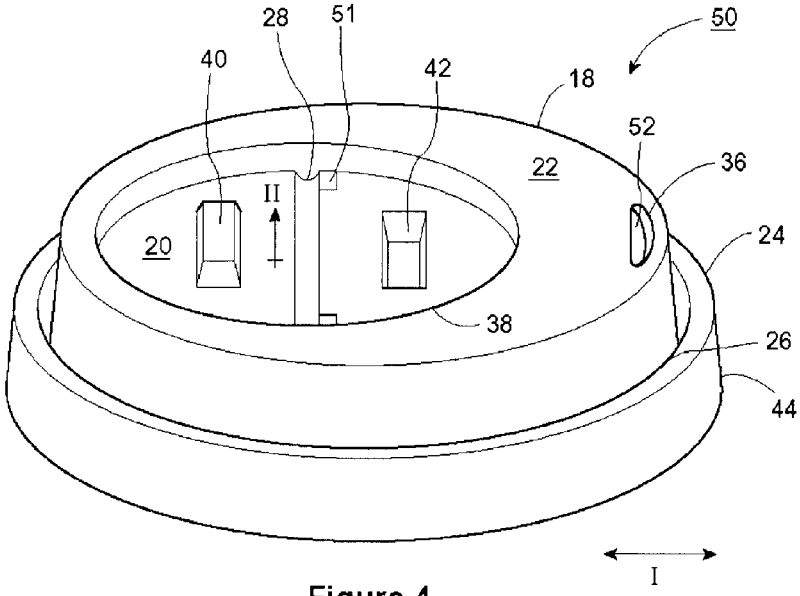
FIG. 4 is a perspective view of a second embodiment of a cup lid in keeping with the present invention, when the reclosable and tearable fold-back tab is in its closed position.

In another embodiment of the present invention as shown in FIG. 4, the first substantially planar region 20, the hinge 28, and the second substantially planar region 22 of cup lid 50 are disposed on the same plane. The cup lid 50 is typically formed from a sheeted material which has an extrusion grain as indicated by arrow I. As such, the longitudinal axis of the hinge 28, which is shown as arrow II, is perpendicular to the extrusion grain. In this particular embodiment, the cup lid may further comprise at least one stop means 51 which is adjacent to the hinge, on the same side as the recess 42 in the first substantially planar region 20. Thus, when the condiment tab 30 is being torn away from the cover portion 18, the stop means 51 prevents the condiment tab 30 from being torn beyond the hinge 28.

Furthermore, as best seen in the second embodiment shown in FIG. 4, the drinking access port 36 of cup lid 50 is defined by a hanging chad 52. When the consumer is ready to consume the beverage in the drinking cup, the hanging chad 52 is dislocated downwardly from the drinking access port 36 such that a drinking opening is provided. In some instances, the hanging chad may be dislocated by simply applying a downward push onto it. An advantage offered by having such a hanging chad 52 is that it provides a slight obstruction to the passage of the beverage flow when the consumer is drinking from the beverage cup. Thus, the flow of the beverage from the beverage cup is carried out in a more controlled manner.

Figure 5:
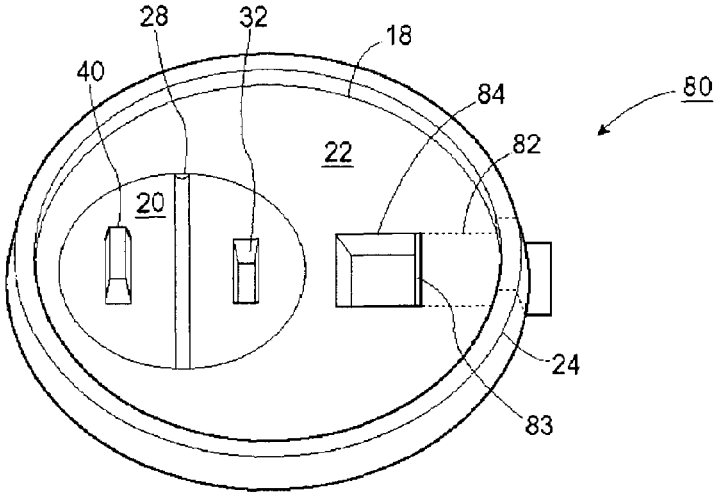
FIG. 5 is a perspective view of a third embodiment of a cup lid in keeping with the present invention, when the reclosable and tearable fold-back tab is in its closed position.

In a third embodiment of the present invention shown in FIG. 5, cup lid 80 comprises a cover portion, a rim portion, a U-shaped hinge, a reclosable and tearable fold-back condiment tab, and a recess which are the same as the corresponding elements described in relation to FIGS. 1 to 4. In this particular embodiment, cup lid 80 is flat and is such that the first, and second substantially planar regions 20 and 22 of the cover portion 18 lie substantially in the same plane. Further, cup lid 80 not only provides a condiment opening 34 which may be opened and re-closed, but it also provides a drinking access port 36 which may be opened or re-closed so as to avoid splashes and spills when the consumer is not drinking the beverage contained in the beverage cup 14. As can be seen in FIG. 5, the drinking access port 36 is defined by a tearable and fold-back drinking tab 82. When the drinking tab 82 is torn and folded back, away from the rim portion 24 of the cup lid 80, the drinking opening 36 is provided. Similar to the tearable and reclosable condiment tab 30, the drinking tab 82 is typically folded back about a U-shaped hinge 83. Preferably, there is provided an indentation 84 in the cover portion 18, in the region of the drinking tab 82, opposite the U-shaped hinge 83 for receiving the drinking tab 82 when it is folded back.

In a preferred embodiment of the present invention, the cup lid is of one piece construction, and is formed from a suitable plastic material. More preferably, the cup lid is thermoformed from extruded plastics sheet material.

Turning now to FIG. 6, an exploded perspective view of the post 40 and the recess 32 which is dimensioned to receive the post 40 are shown. Preferably, the post 40 has grip means 41 which aids the consumer in tearing the reclosable and tearable condiment tab 30.

While only specific combinations of various features and components of the present invention have been discussed herein, it will be apparent to those skilled in the art that desired subsets of the disclosed features and components and/or alternative combinations of these features and components can be utilized, as desired.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. A cup lid for placement onto the rim of a drinking cup having a substantially circular opening at its upper end, comprising:

a cover portion having at least first and second substantially planar regions, a condiment opening defined in the first substantially planar region, and a drinking access port defined in the second substantially planar region and substantially opposite the condiment opening, said condiment opening being larger than said drinking access port to permit the insertion of condiment into the drinking cup independently of said drinking access port;

a rim portion around the periphery of the cover portion, and sealingly securable to the upper end of the drinking cup;

a hinge formed in the first substantially planar region, the hinge being formed at least partially along a chord and being bisected by a diameter of the cup lid;

a reclosable and tearable fold-back condiment tab in the first substantially planar region which is defined by the hinge and by fault lines formed in the first substantially planar region, the reclosable and tearable fold-back condiment tab having an upstanding post provided thereon; and a recess in the first substantially planar region which is dimensioned to frictionally receive the post of the condiment tab when it is torn and folded back;

whereby when the condiment tab is torn and folded back, the condiment opening is formed and said condiment tab covers a remaining portion of said first substantially planar region, which lies within an inner portion of said cover portion; and wherein said first substantially planar region extends over at least about half of the surface of said cover portion.

2. The cup lid of claim 1, wherein said cup lid is dome shaped and is such that said cover portion is disposed above said rim portion.

3. The cup lid of claim 1, wherein said drinking access port is in the peripheral region of said cover portion.

4. The cup lid of claim 1, wherein said drinking access port provides a readily accessible drinking opening.

5. The cup lid of claim 1, wherein said drinking access port is defined by a hanging chad such that when said hanging chad is dislocated from said drinking access port, a drinking opening is provided.

6. The cup lid of claim 1, wherein said first substantially planar region and said hinge are disposed below said second substantially planar region.

7. The cup lid of claim 1, wherein said hinge is an U-shaped hinge.

8. The cup lid of claim 1, wherein said fault lines are pre-cut.

9. The cup lid of claim 1, wherein said fault lines are scored.

10. The cup lid of claim 1, wherein said rim portion has a channel defined therein, and a skirt downwardly extending therefrom such that when said cup lid is sealingly secured to the upper end of the drinking cup, the rim of the drinking cup is received in said channel of said cup lid and frictionally fitted therein.

11. The cup lid of claim 1, wherein said cup lid is formed from a sheeted material which has an extrusion grain, and wherein said hinge has an longitudinal axis which is parallel to said extrusion grain.

12. The cup lid of claim 7, wherein said cup lid is formed from a sheeted material which has an extrusion grain, and wherein said U-shaped has an longitudinal axis which is substantially perpendicular to said extrusion grain.

13. The cup lid of claim 1, wherein said cup lid has at least one stop means which is adjacent to said hinge, on the same side as said recess in said first substantially planar region, so as to prevent said tearable fold-back condiment tab from being torn beyond said hinge.

14. The cup lid of claim 1, wherein said upstanding post of said tearable fold-back condiment tab has grip means which aids in the tearing of said condiment tab.

15. The cup lid of claim 1, wherein said cup lid is flat and is such that said first and second substantially planar regions of said cover portion lie substantially in the same plane.

16. The cup lid of claim 15, wherein said drinking access port is defined by a tearable fold-back drinking tab extending into said rim portion such that when said drinking tab is torn and folded back, a part of said rim portion is torn away and a drinking opening is formed.

17. The cup lid of claim 15, wherein said drinking access port is defined by a tear tab such that when said tab is torn and dislocated away from said drinking access port, a drinking opening is accessible.

* * * * *